US005359150A

United States Patent [19]

Ikeuchi

[11] Patent Number: 5,359,150

[45] Date of Patent: Oct. 25, 1994

[54] WIRE RIBBON

[75] Inventor: Hiroshi Ikeuchi, Nagaokakyo, Japan

[73] Assignee: Murata Mfg. Co., Ltd., Kyoto, Japan

[21] Appl. No.: 126,054

[22] Filed: Sep. 23, 1993

[30] Foreign Application Priority Data

Sep. 30, 1992 [JP] Japan ..... 4-285530

[51] Int. Cl.[5] ..... H01B 7/08

[52] U.S. Cl. ..... 174/117 F; 174/117 A

[58] Field of Search ..... 174/117 F, 117 FF, 117 R, 174/117 A

[56] References Cited

U.S. PATENT DOCUMENTS

| | | | |
|---|---|---|---|
| 4,356,345 | 10/1982 | Gonia | 174/117 F |
| 4,486,253 | 12/1984 | Gonia | 174/117 F |
| 4,650,924 | 3/1987 | Kauffman et al. | 174/117 F |
| 4,780,157 | 10/1988 | Coon | 156/53 |
| 5,010,642 | 4/1991 | Takshashi et al. | 174/117 F |

FOREIGN PATENT DOCUMENTS

| | | | |
|---|---|---|---|
| 97414 | 1/1984 | European Pat. Off. | 174/117 F |
| 2326017 | 12/1973 | Fed. Rep. of Germany | 174/117 F |
| 1-166410 | 6/1989 | Japan | 174/117 F |
| 3254018 | 11/1991 | Japan . | |

*Primary Examiner*—Morris H. Nimmo

*Attorney, Agent, or Firm*—Rogers, Howell & Haferkamp

[57] ABSTRACT

A wire ribbon has a plurality of insulator-coated conductive wires, each having an insulating layer formed on a surface of a conductive wire. The insulator-coated conductive wires are arranged parallel in a row to be adjacent to each other. The adjacent insulator-coated conductive wires are bonded to each other through interconnection adhesive layers so as to be integrated. A thermoplastic adhesive interlayer having an adhesion temperature lower than that of the interconnection adhesive layer is formed in a local circumferential region on an apex of each single-core wire on at least one of upper and lower surface sides of the wire ribbon.

2 Claims, 3 Drawing Sheets

WIRE RIBBON

BACKGROUND OF THE INVENTION

1. FIELD OF THE INVENTION

The present invention relates to a wire ribbon used for a deflection yoke coil mounted in a television receiver, a display unit, and the like.

2. DESCRIPTION OF THE RELEVANT ART

With the recent development of high-vision television receivers and high-definition display units, the specifications associated with color mismatching, i.e., misconvergence, of the cathode-ray tube screens of these apparatuses tend to be stricter. With this tendency, it is earnestly desired that a deflection magnetic field be controlled more precisely.

A deflection yoke mounted in the cathode-ray tube of a television receiver or a display unit is designed such that horizontal deflection coils are wound on the top and bottom sides of a bobbin as a funnel-shaped winding frame along its inner surface, and a vertical deflection coil and a core are wound around the bobbin.

FIG. 1 shows an example of a bobbin for a saddle type deflection coil used for a general deflection yoke. A plurality of coil-winding grooves 5 are formed in this bobbin 2. For example, coiling wires 11 shown in FIG. 2 are wound in layers along these coil-winding grooves 5, thus forming a deflection coil. As the coiling wire 11, a conductive wire (including a litz wire) coated with an insulating layer 4 is used.

In winding the coiling wires 11 along the coil-winding groove 5, if the coiling wires 11 are not bound, conductive wires are wound in layers one by one or several wires at a time by an automatic winding machine, thus forming a deflection coil.

Owing to variations in the stretching force acting on the coiling wires 11 as they are wound and other reasons, the coiling wires 11 are displaced and biased as shown in FIG. 2, or the order of winding of the coiling wires 11 is altered and hence such winding as previously designated by a design instruction cannot be practiced. Furthermore, since the biased states of the coiling wires 11 of deflection coils that are mass-produced differ from one another for each product, a deflection field cannot be regulated with high precision. In addition, mass-produced products vary in quality, and hence the yield decreases. Therefore, this conventional winding method is disadvantageous in terms of cost. Even in the conventional winding method, as the width of the coil-winding groove is reduced, the displacement and bias of each coiling wire 11 are reduced to satisfy the original design. In this case, however, a ratio L/R between an inductance L and a resistance R is reduced, resulting in a deterioration in coil performance.

In order to solve the above problems, the applicant of the present invention has previously proposed a deflection coil formed by using wire ribbons, each constituted by a plurality of conductive wires bound to be arranged parallel in a row as shown in FIG. 3, instead of using single conductive coil wires one by one as in the prior art.

A wire ribbon 15 is formed as follows. As shown in FIG. 3, a plurality of single-core wires, each having an insulating layer 4 and a hot-melt adhesive layer 9 formed on the surface of a conductive wire 8 consisting of copper, aluminum, or the like, are arranged parallel in a row and are bonded to each other so as to be integrated into the wire ribbon 15.

Since the single-core wires of the wire ribbon 15 are orderly fixed within the wire ribbon 15, the single-core wires are not shifted within the wire ribbon 15, or the order of the wires is not altered. Therefore, by winding these wire ribbons 15 in layers along the coil-winding groove 5, a deflection coil can be manufactured, which is free from the above-described problem of the great displacement of each single-core wire.

When the wire ribbons 15 are wound in layers along the coil-winding groove 5 to form coil layers, and the coil layers are to be bonded to each other, the wire ribbons are energized and heated while the coil layers are pressed by a pressurizing jig 20, as shown in FIG. 4. With this operation, the hot-melt layers of the respective coil layers are melted and bonded to each other. However, since the width of the coil-winding groove 5 is set with a margin with respect to the width of the wire ribbon 15 so as to allow the wire ribbon 15 to be smoothly inserted, upper and lower wire ribbons may be wound to be displaced from each other. In such a case, when the hot-melt layers are melted by energizing and heating while the wire ribbons 15 are pressed, part of the pressing force acting on the single-core wire 14 of the upper layer is obliquely applied to a displaced single-core wire **14*a* of the lower layer. As a result, the single-core wire 14*a* of the lower layer is separated and moved toward a gap 12 between the coil-winding groove 5 and the wire ribbon 15. For example, as shown in FIG. 5, a single-core wire 14*b* of the upper layer enters a gap 12*a* between single-core wires 14*a* and 14*a*' of the lower layer. As a result, the wire ribbons 15** may be bonded and solidified in a deformed state, e.g., a distorted or biased state.

SUMMARY OF THE INVENTION

The present invention has been made in consideration of the above situation, and has as its object to provide a wire ribbon which can prevent single-core wires from being deformed upon shifting or separation from each other as adhesive layers between the adjacent single-core wires are melted when a plurality of coil layers wound in layers are energized and heated to be bonded to each other.

In order to achieve the above object, according to the main aspect of the present invention, there is provided a wire ribbon having a plurality of insulator-coated conductive wires, each having an insulating layer formed on a surface of a conductive wire, the insulator-coated conductive wires being arranged parallel in a row to be adjacent to each other, and the adjacent insulator-coated conductive wires being bonded to each other through interconnection adhesive layers so as to be integrated, characterized in that a thermoplastic adhesive interlayer having an adhesion temperature lower than that of the interconnection adhesive layer is formed in a local circumferential region on an apex of each single-core wire on at least one of upper and lower surface sides of the wire ribbon.

According to the embodiment, the thermoplastic adhesive interlayers having an adhesion temperature lower than that of the interconnection adhesive layer are formed in the local circumferential regions on the apexes of each single-core wire of the wire ribbon. For this reason, when a plurality of coils layers formed by winding wire ribbons in layers are to be bonded to each other, the adhesive interlayers can be melted to bond the plurality of coil layers to each other at a temperature lower than the adhesion temperature of the interconnection adhesive layer without melting the interconnection adhesive layers. Even if, therefore, a pressure acts on the coil layers, the single-core wires are not shifted or separated from each other, thereby preventing deformation of each wire ribbon.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 6:
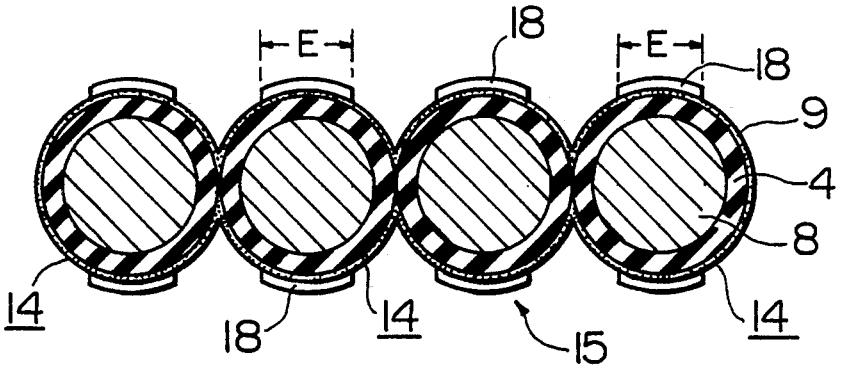
FIG. 6 is a sectional view showing an example of a wire ribbon according to the present invention.

Several preferred embodiments of the present invention will be described below with reference to the accompanying drawings (FIGS. 6 to 8A and 8B). The same reference numerals in the embodiments denote the same parts as in the above-described prior art, and a detailed description thereof will be omitted. FIG. 6 is a sectional view of a wire ribbon 15 according to the first embodiment of the present invention.

The wire ribbon 15 is constituted by a plurality of insulator-coated conductive wires (single-core wires) 14, each obtained by forming an insulating layer 4 on the surface of a conductive wire 8 consisting of copper, aluminum, or the like. Hot-melt interconnection adhesive layers 9 are respectively coated on the surfaces of all the single-core wires 14 in advance. These single-core wires 14 are then arranged parallel in a row to be adjacent to each other in the form of a belt. As a result, the adjacent single-core wires 14 are bonded to each other through the hot-melt interconnection adhesive layers 9 so as to be integrated into the wire ribbon 15. A thermoplastic adhesive interlayer 18 having an adhesive temperature (melting point) lower than that of the interconnection adhesive layer 9 is formed in a local circumferential region E on the apex of each single-core wire 14 on at least one of the upper and lower surface sides of the wire ribbon 15 (both sides in the embodiment shown in FIG. 6).

The wire ribbon of this embodiment is manufactured as follows. First, as shown in FIG. 6, the interconnection adhesive layer 9 is coated on the surface of each single-core wire 14 having the insulating layer 4 formed on the surface of the conductive wire 8. These single-core wires 14 are then arranged parallel in the form of a belt. Thereafter, the interconnection adhesive layers 9 are heated to be melted and fused to each other, thus forming the wire ribbon 15. The thermoplastic adhesive interlayers 18 having an adhesive temperature lower than that of the interconnection adhesive layer 9 are formed in the local circumferential regions E on the apexes of each single-core wire 14 on the upper and lower surface sides of the wire ribbon 15.

Figure 7:
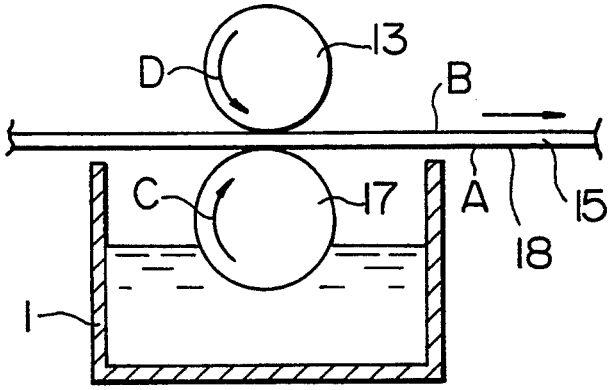
FIG. 7 is a view for explaining a method of forming adhesive interlayers of the wire ribbon of the present invention.

For example, these adhesive interlayers are formed by the following method. As shown in FIG. 7, a metal or rubber roller 17 is immersed in a hot-melt bath 1 containing a melted hot-melt material, and the wire ribbon 15 is inserted between the roller 17 and a press roller 13. The roller 17 is then rotated in the direction indicated by an arrow C to transfer/coat the hot-melt material on the local circumferential regions E on the apexes of a surface A of the wire ribbon 15. Subsequently, the hot-melt material is also transferred/coated on a surface B of the wire ribbon 15 by the same method. With the above-described method, the adhesive interlayers 18 are formed. Since the shape of each adhesive interlayer 18 differs depending on the material for the roller 17 and the thixotropy of an interlayer adhesive (hot-melt material), a desired shape can be obtained by adjusting these factors.

According to the embodiment, the thermoplastic adhesive interlayers 18 having an adhesion temperature lower than that of the interconnection adhesive layer 9 are formed in the local circumferential regions E on the apexes of each single-core wire 14 of the wire ribbon 15. For this reason, when the coil layers of the wire ribbons 15 which are wound in layers along coiling-wire grooves for a deflection yoke coil are to be energized and heated to be bonded to each other, the adhesive interlayers 18 can be melted and fused to each other at a temperature lower than the melting point of the interconnection adhesive layer 9 without melting the interconnection adhesive layers 9. Even if, therefore, a pressure acts on the coil layers, the single-core wires 14 are not shifted or separated from each other, thereby preventing deformation of each wire ribbon 15.

Since deformation of the wire ribbon 15 is prevented, variations in coiling wires can be suppressed.

If the adhesive interlayers 18 are entirely coated on one surface or both surfaces of the wire ribbon 15, the rigidity of the wire ribbon 15 is increased due to the adhesive interlayers 18 and is not easily bent. That is, the wire ribbon 15 is difficult to handle. In contrast to this, according to the embodiment, since the adhesive interlayers 18 are coated in the local circumferential areas E on the apexes of the single-core wires 14 of the wire ribbon 15, gaps are formed between the conductive wires 8. Therefore, the wire ribbon 15 does not have excessive rigidity, and maintains flexibility with a small spring-back force, allowing easy handling.

The present invention is not limited to the embodiment described above, and various changes and modifications of the embodiment can be made. For example, in the above embodiment, the adhesive interlayers 18 are formed on the upper and lower surfaces of the wire ribbon 15. However, the adhesive interlayers 18 may be formed on only one surface of the wire ribbon 15.

In the above embodiment, the interconnection adhesive layers 9 and the adhesive interlayers 18 of the wire ribbon 15 are constituted by hot-melt layers. However, thermoplastic adhesive layers other than hot-melt layers may be used. In this case, a thermoplastic resin having a melting point lower than that of the interconnection adhesive layer 9 is used for each adhesive interlayer 18.

Figure 1:
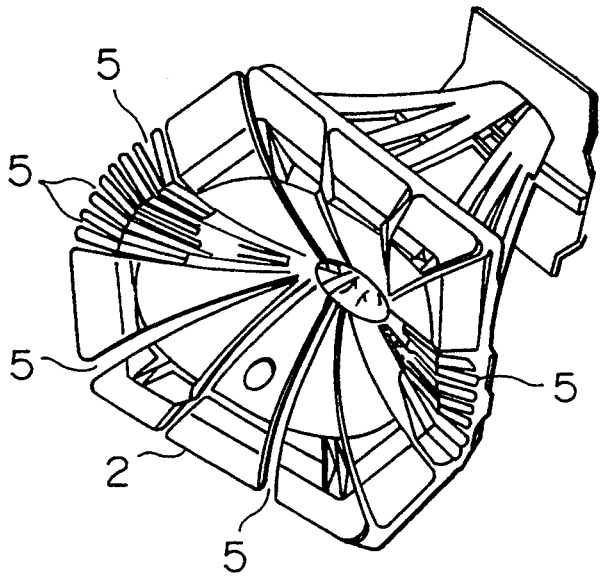
FIG. 1 PRIOR ART
FIG. 1 is a schematic perspective view showing an example of a bobbin for a conventional deflection coil.
Figure 2:
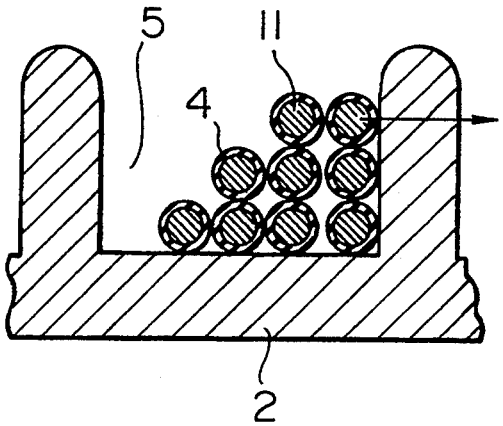
FIG. 2 PRIOR ART
FIG. 2 is a partial sectional view showing a state of coil windings in the conventional deflection coil.
Figure 3:
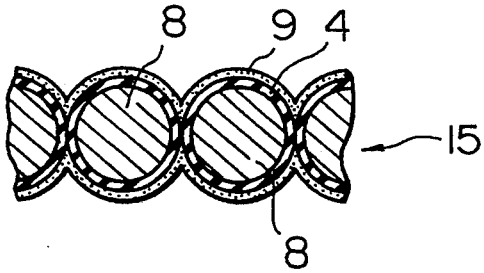
FIG. 3 PRIOR ART
FIG. 3 is a partial sectional view showing a portion of a conventional wire ribbon.
Figure 4:
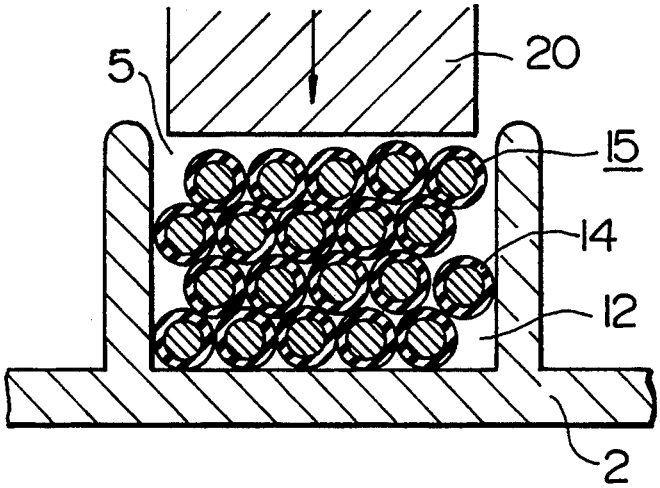
FIG. 4 PRIOR ART
FIG. 4 is a sectional view showing a state wherein a pressure is applied to a deflection coil formed by winding conventional wire ribbons in layers along a coil-winding groove.
Figure 5:
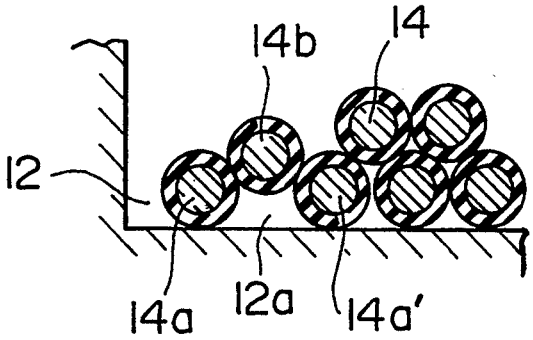
FIG. 5 PRIOR ART
FIG. 5 is a partial sectional view showing a state wherein conventional wire ribbons are deformed in a coil-winding groove.
Figure 8A:
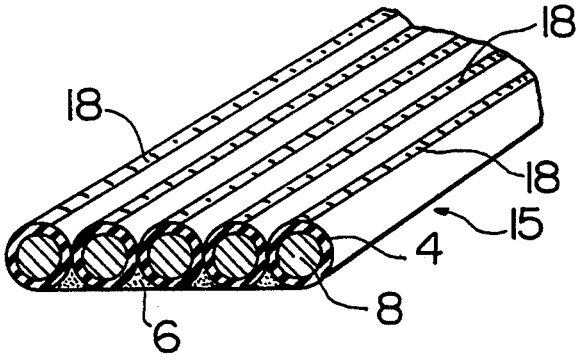
FIGS. 8A and 8B are a perspective view and a sectional view, respectively, showing other examples of the wire ribbon of the present invention.
Figure 8B:
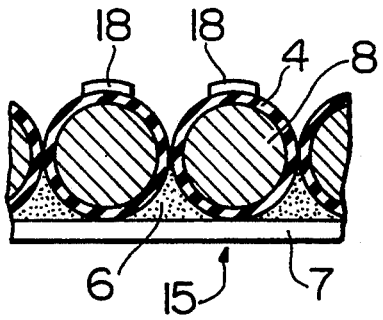

In the above embodiment, the adhesive interlayers 18 shown in FIG. 6 are formed on the wire ribbon 15 shown in FIG. 3. However, as shown in FIG. 8A, a wire ribbon 15 having a plurality of conductive wires 8 coated with insulating layers 4, arranged parallel in a row, and bonded to each other through a hot-melt layer 6 may be used. Alternatively, as shown in FIG. 8B, a wire ribbon 15 having a plurality of conductive wires 8 coated with insulating layers 4, arranged parallel in a row on one surface of an insulating sheet 7 consisting of a resin material or the like, and bonded to each other through a hot-melt layer 6 may be used. In this case, a hot-melt material having a melting point lower than that of the hot-melt layer 6 is also used for each adhesive interlayer 18.

The above-described embodiments are associated with the wire ribbons for deflection coils. However, the wire ribbons of the present invention can be applied to coiling wires in other fields, e.g., transformer coils.

What is claimed is:

1. A wire ribbon having a plurality of insulator-coated conductive wires, each having an insulating layer formed on a surface of a conductive wire, said insulator-coated conductive wires being arranged parallel in a row to be adjacent to each other, and said adjacent insulator-coated conductive wires being bonded to each other through interconnection adhesive layers so as to be integrated, wherein a thermoplastic adhesive interlayer having an adhesion temperature lower than that of said interconnection adhesive layer is formed in a local circumferential region on an apex of each single-core wire on at least one of upper and lower surface sides of said wire ribbon.

2. A wire ribbon according to claim 1, wherein said adhesive interlayer is a hot-melt layer.

* * * * *